US006731770B1

(12) United States Patent
Vonlanthen

(10) Patent No.: US 6,731,770 B1
(45) Date of Patent: May 4, 2004

(54) BEHIND-THE-EAR HEARING AID AND SURFACE-MOUNTED MODULE FOR THIS TYPE OF HEARING AID

(75) Inventor: Andi Vonlanthen, Remetschwil (CH)

(73) Assignee: Phonak AG, Stafa (CH)

( * ) Notice: Subject to any disclaimer, the term of this patent is extended or adjusted under 35 U.S.C. 154(b) by 0 days.

(21) Appl. No.: 09/340,951

(22) Filed: Jun. 28, 1999

(30) Foreign Application Priority Data

Jun. 16, 1999 (WO) ..... PCT/CH99/00259

(51) Int. Cl.[7] ..... H04R 25/00
(52) U.S. Cl. ..... 381/330; 381/314; 381/323
(58) Field of Search ..... 381/314, 322, 381/323, 324, 327, 330, 381, FOR 127, FOR 129, FOR 131, FOR 134

(56) References Cited

U.S. PATENT DOCUMENTS 3,101,155 A 8/1963 Lehr et al.
4,961,230 A * 10/1990 Rising ..... 381/322
6,546,110 B1 * 4/2003 Vonlathen ..... 381/330

FOREIGN PATENT DOCUMENTS

| | | | | |
|---|---|---|---|---|
| CH | 000668154 | * | 11/1988 | ..... 381/FOR 134 |
| DE | 36 24 568 A1 | | 1/1988 | |
| DE | 37 23 809 A1 | | 1/1989 | |
| DE | 3723809 | * | 1/1989 | ..... 381/FOR 134 |
| EP | 0 337 195 A2 | | 10/1989 | |
| EP | 500 988 A1 | | 9/1992 | |
| GB | 2 305 067 A | | 3/1997 | |

* cited by examiner

*Primary Examiner*—Huyen Le
(74) *Attorney, Agent, or Firm*—Pearne & Gordon LLP

(57) ABSTRACT

A behind-the-ear hearing aid, which extends basically like a tube along an axis and has a battery compartment (29) on the end. Instead of a battery, the plug part (34) of an additional module (51) can be plugged in, and a corresponding battery compartment is then provided in the additional module (51).

16 Claims, 5 Drawing Sheets

BEHIND-THE-EAR HEARING AID AND SURFACE-MOUNTED MODULE FOR THIS TYPE OF HEARING AID

This invention concerns a behind-the-ear hearing aid according to the preamble to claim 1, and a surface-mounted module for this type of hearing aid according to claim 7.

Behind-the-ear hearing aids with a hook-shaped curved body, basically along a likewise curved axis, with acoustic/electric transducers, electric/acoustic transducers and electronic units built in, are known. One end of them, usually the tapering end, forms the body of the acoustic output to the ear.

Such behind-the-ear hearing aids have a storage battery or battery compartment.

Usually, a round cell battery is used on these types of hearing aids, hence a basically cylindrical battery or storage battery body, so that its cylinder axis is positioned across the axis of the body mentioned. The hearing aid housing has a hinged cover for this, with holders for the cylindrical body, in such a way that its cylindrical axis runs parallel to the swivel axis of the hinged cover. This arrangement has disadvantages in various ways:

Because of the fact that the cylindrical body of the battery or storage battery runs transverse to the longitudinal axis of the hook-shaped curved hearing-aid body, a relatively large amount of space in the hearing aid is wasted by the battery. There are also dividing lines running between the hinged cover and the housing of the hearing aid, basically along generating lines of the hook-shaped curved hearing-aid body, and at least some of them, when the hearing aid is worn, lie directly on the skin of the wearer and form a relatively long, critical point, through which sweat and exhalation vapor, etc. can penetrate inside the battery compartment.

The purpose of this invention is to remove these disadvantages. For this purpose, the behind-the-ear hearing aid in the invention is characterized by the features in Claim 1. In it, the battery compartment is at the end of the body opposite the acoustic output, and the space inside it is designed for a cylindrical storage battery or battery body, so that its cylindrical axis is basically coaxial to the longitudinal axis of the device. With the basically cylindrical cross section—especially the inside cross section—of the body of the device, optimally less structural volume is needed for the battery or storage battery body, since it can be inserted coaxially to the axis of the tube of the device, practically flush with the housing wall.

In one preferred form of embodiment, the compartment mentioned, preferably in turn coaxial to the longitudinal axis of the device, has a first, preferably spring, preferably center tap contact and in the area of the compartment wall, at least one second one.

Although a battery placed in the compartment for the tap needs only two tap contacts, it can, if necessary, be advantageous to provide more than two electrical contacts in the compartment mentioned, for the other preferred form of embodiment of the hearing aid in the invention. For it, instead of a battery or storage battery in the compartment mentioned on the body of the device, the plug part of a surface-mounted or add-on module can be inserted and electrical contact made with the contacts mentioned, at least two or, if necessary more. On the surface-mounted module, which now acts on the actual battery compartment on the body of the device, there is, on the end opposite the plug part, at least one basically identical compartment, like the compartment on the body of the device mentioned. With it, such a module can be inserted into the battery compartment of the body of the device, and the electric power is supplied via a cylindrical battery or storage cell now inserted in the compartment of the surface-mounted module.

Of course, according to this principle, more than one surface-mounted module can be coupled modularly to the actual body of the device, in practice extending the hook-shaped body of the device.

The compartment, whether it is on the body of the device or—as mentioned—on a surface-mounted module, also has a closed cover basically perpendicular to the longitudinal axis of the device, which can preferably be locked, preferably only by means of a tool. This provides a safety device for use with children: without the help of a tool, like a screw driver, for example, the battery or storage battery cannot be taken out of the hearing aid.

According to the modular design principle, the cover mentioned can also preferably be removed from the body of the hearing aid without being destroyed, in such a way that it can be used, for example, after removing said cover on the body of the hearing aid compartment or on the compartment of a surface-mounted module.

It is also common to place a code, for example a color code, on a behind-the-ear hearing aid, which identifies the ear—left or right—for which the device is designed.

So that the parts that must be given a fixed code during manufacturing are not relatively complicated, it is also proposed that the cover mentioned have a left-right ear code, and preferably on part of a lock mounted on the cover and visible from the outside. Thus during manufacturing all covers can be manufactured the same, and only during assembly of a simple lock will, for example, red or blue parts color-coded from the outside be used.

This invention also concerns, according to the wording of Claim 6, a behind-the-ear hearing aid that has a modular design and a hook-shaped curved body, on one end of which there is a compartment where at least two electrical contacts are bare. The plug part of a module can be inserted into the compartment, which module is in turn equipped on the end facing away from the plug preferably with a compartment basically identical to the compartment mentioned on the body of the device. Apart from the question of how and where a battery or storage battery is mounted on the behind-the-ear hearing aid, it is extremely advantageous to provide the compartment mentioned on the hearing aid, with which correspondingly designed surface-mounted modules can optionally be provided on the same basic configuration.

One surface-mounted module in the invention for a hearing aid of the type mentioned above has a plug part preferably basically defining a cylindrical outer surface, and on the module, opposite the plug part, there is a compartment, which is designed for a molded part basically like the plug that can be locked with a preferably removable cover that can preferably be locked, preferably with a tool. The modules preferably used as surface-mounted modules are modules for a wireless communication interface or a plug adapter module to adjust the hearing aid or other acoustic/electric transducer arrangements, a storage battery module, which is usually built bigger than the battery cells usually used, a programming module or a mechanically activated module.

The behind-the-ear hearing aid in the invention and the surface-mounted module in the invention will be explained below using figures which show one embodiment of the behind-the-ear hearing aid that is preferred today.

Figure 1:
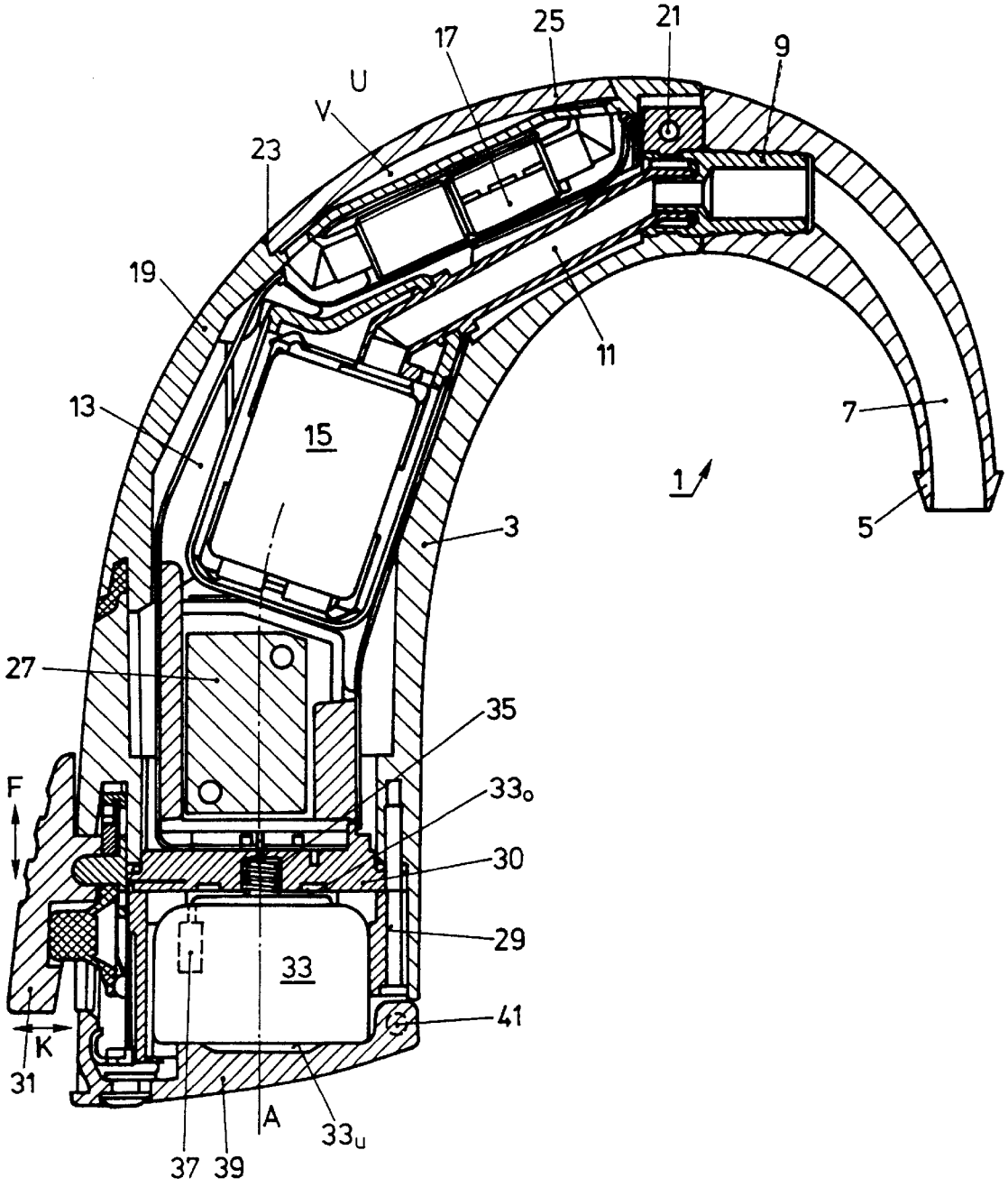
FIG. 1 shows a simplified behind-the-ear hearing aid in the invention in a longitudinal section.

FIG. 1 shows a somewhat simplified longitudinal section of the behind-the-ear hearing aid in the invention as a whole, where the individual function blocks and function parts are first described. The hearing aid 1 includes a horn-shaped curved, tubular basic body with a central axis A, which has a connecting support 5 for a coupling tube leading into the ear on the thinner, uncurved end, as an acoustic output. The connecting supports 5 can be exchanged for a tube support 9, which sits, is set on or screwed on a basic housing.

The inner channel 7 of the connecting support 5 continues through the tubular support 9 into a transmission channel 11 in the basic housing 3. The transmission channel 11 in turn is coupled to an electric/acoustic transducer arrangement 15 in one compartment 13 of the basic housing 3.

Figure 2:
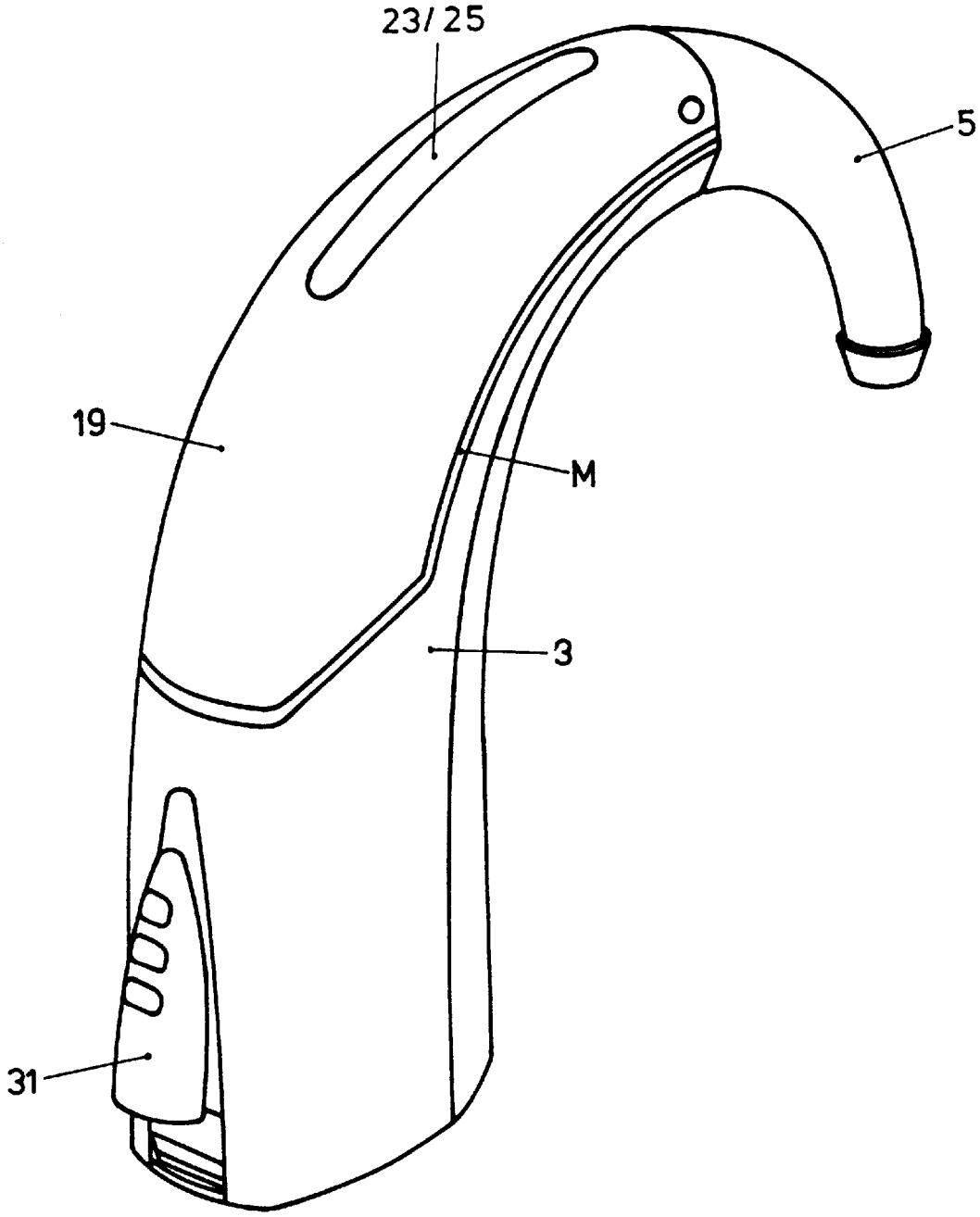
FIG. 2 shows a perspective view of the hearing aid in the invention.

As can be seen from FIG. 1, the transmission channel 11 extends along the inner curve of the basic housing 3 in such a way that there is room for a microphone unit 17 on the outer curve. The basic housing 3 has a cover 19 molded into it in this area and in the area of the culmination point of the device is stopped by means of a plug axis 21. As can be seen especially in FIG. 2, the cover 19 extends along generating line M of the device body, up into the area of the electric/acoustic transducer unit 15, FIG. 1. The microphone unit 17 is accessible when the folding cover 19 is removed and preferably makes electrical contact only on a flexprint strap (not shown), folded over the transmission channel 11 and is on a sound-input slot 23.

When the cover 19 is closed, at least two holes in the microphone unit 17 are opposite an insert 25 in a slot 23 in the cover 19. The insert 25 is acoustically "transparent" and has a large number of passages between the environment U and an equalization volume V, which latter is left free between the discreet microphone inlet openings (not shown) and said insert. Preferably the insert 25 is made of a sintered material, like especially sintered polyethylene and even more preferably coated so it is water-repellant. It also forms a grid fineness between 10 $\mu$m and 200 $\mu$m with an open porousness of preferably over 70%. Furthermore, the microphone unit 17 and the insert 25 are arranged in the slot 23 on the hearing aid 1 so that when the hearing aid is worn, they are exposed, if possible, to no dynamic air pressure from the environment U, by being positioned—as can be seen in FIG. 1—in the area of the cup of the horn-shaped curved, tubular basic body. Especially when an acoustic/electric transducer with directional characteristics is made using at least the two spaced microphones mentioned, due to the intermediate volume V, in the sense of a "common mode" suppression, different coupled equal acoustic signals along the insert 25 have a tendency to be compensated because of the equalizing effect of the volume V.

The insert 25 also protects against dirt and is easy to clean due to its preferred water-repellant coating.

Another advantage of the insert 25 with its large number of passages is—closely coupled with the aspect of the above-mentioned "common mode" suppression—that all kinds of dirt have the same effect on both microphones and there is therefore no worsening of the directional effect (directional characteristic), which is a central problem with conventional directional microphones with two and more discrete holes.

Please refer to EP-A-0 847 227 by the same applicant concerning this insert 25 and its effects.

After the electric/acoustic transducer arrangement 15 in the basic housing 3, there is an electronic unit 27, then a battery compartment 29. On the outside of the basic housing, in the area between the battery compartment 29 and the electronic unit 27, there is an activating switch 31. The perspective view in FIG. 2 clearly shows in particular the connecting supports 5, the basic housing 3, the cover 19 with the sound-input slot 23 and insert 25, and the activating switch 31.

Battery Compartment

A flat cylindrical battery or a correspondingly molded storage battery 33 is inserted into the battery compartment 29 in the end of the basic housing 3, in such a way that the axis of the battery cylinder, with its front surfaces $\mathbf{33}_u$ and $\mathbf{330}_o$, lies at least basically coaxial to the longitudinal axis A of the basic body.

On the base 30 of the battery compartment 29, centered in axis A, there is a first spring contact 35; a second 37 makes spring contact with the side of the battery 33. The battery compartment 29 can be locked with a cover 39 that is transverse to axis A in the closed position and is swivel- or bayonet-mounted, at 41, on the basic housing 3 or on the battery compartment 29.

This transverse arrangement of the battery 33 on the hearing aid has major advantages: The surface closed by the cover 39 is relatively large and can be used further, as will be described later. Because the battery compartment cover 39 is arranged at the deepest place on the device and the cover impact points are transverse to the axis A to the basic housing 3, penetration of sweat into the battery compartment is barely critical. Furthermore, with this battery compartment design, the contacts 37 and 35 inside the compartment are protected, and the cover 39 has no electrical contacts. Because the basically cylindrical space inside the basic body 3 is used up, there is practically no unused lost space.

Figure 3:
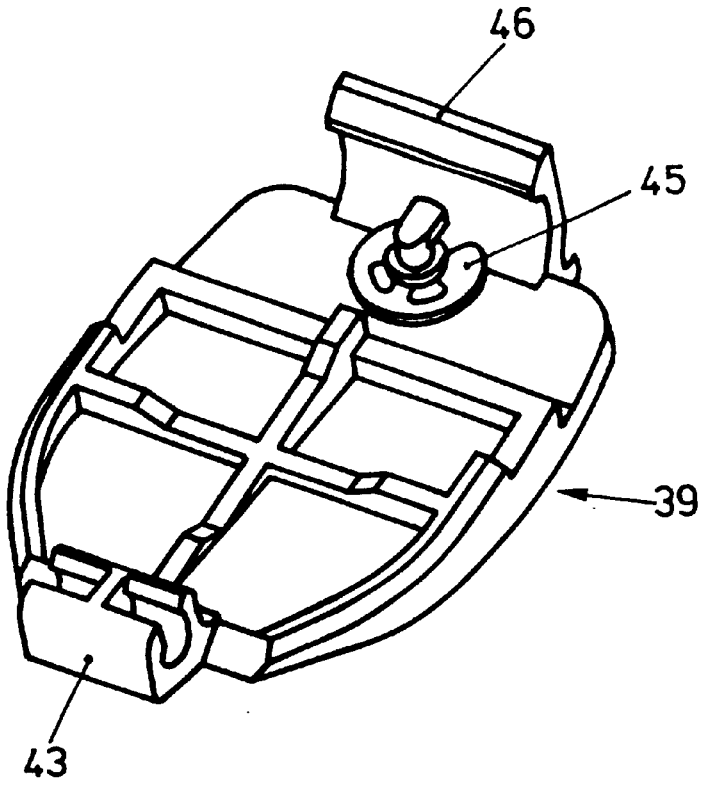
FIG. 3 shows a perspective view of the preferred design of a battery compartment cover on the hearing aid in the invention.

FIG. 3 is a perspective view of one preferred form of embodiment of the battery compartment cover 39, designed as a folding cover. With the snapping hinge part 43, it can be unlatched from the swivel bearing 41 in FIG. 1 and locked. In one preferred form of embodiment, it also has a lock 45, plus a spring catch 46.

Figure 4:
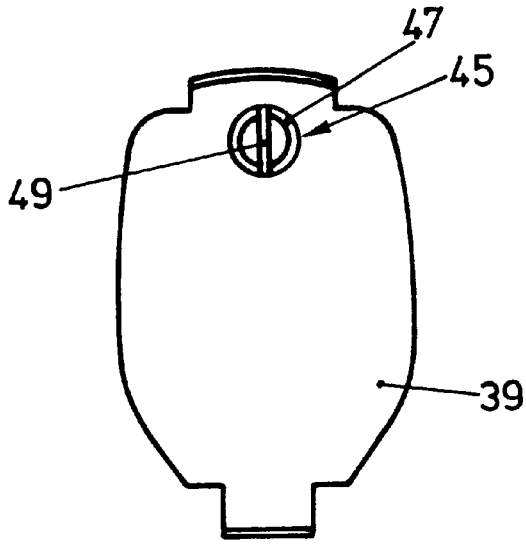
FIG. 4 shows a top view of the cover in FIG. 3 with parts with left-right ear coding.

FIG. 4 shows the cover 29 in FIG. 1 in an outer view. The lock 45 can only be used from the outside with a tool, for example a screw driver and has a slot 49 on a rotating plate 47 for this. The plate 47, which is built onto the folding cover 39 when the lock is mounted is specifically colored in two designs, for example red and blue, so that this part is also used as an indicator of whether the hearing aid in question is for the left or right ear.

As was mentioned, the embodiment of the battery compartment 29 shown, especially the fact that the flat battery cylinder is coaxial to axis A of the hearing aid, has another important advantage. The hearing aid shown in FIG. 1 is a basic configuration.

Figure 5:
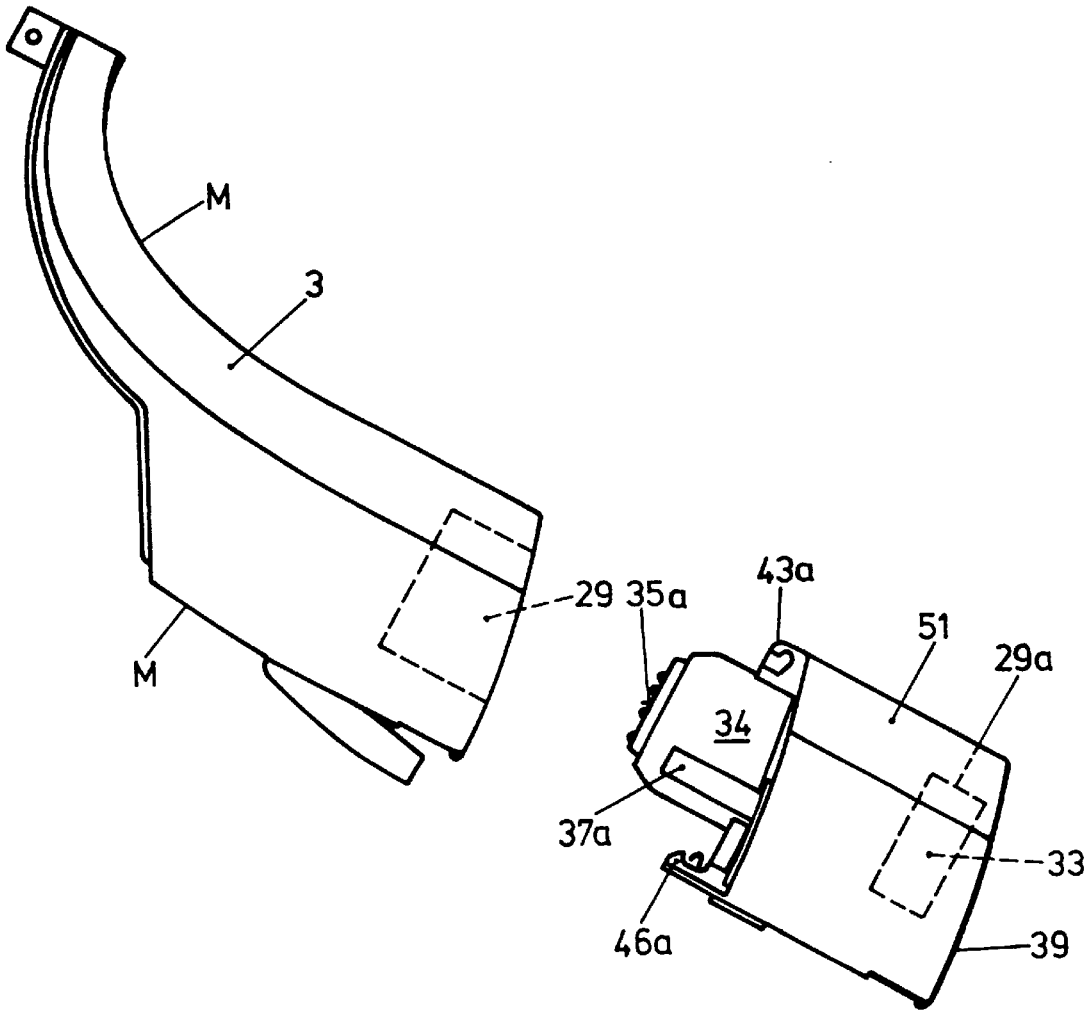
FIG. 5 shows, on one hand, the basic housing of the device in the invention, and on the other hand, an added module that is provided or could be, in a perspective view.

There is often a desire to equip this basic configuration with more options, for example with an interface unit for wireless signal transmission of a programming plug-in unit, another audio input, a larger storage battery compartment, a mechanical activating unit, etc. For this, the battery compartment shown in FIG. 1 is reconfigured as shown in FIG. 5. The battery 33 is taken out of the compartment and instead of it, the plug-in part 34 of a corresponding extra module 51 is plugged in and makes electrical contact at the contact points 35*a* and 37*a* for the battery contacts.

To use such extra modules, it is always possible to provide other contacts in the compartment 29.

The compartment 29*a* now acting as an actual battery compartment with battery 33 is now provided on the extra module 51 and, accordingly, the cover 39, which is removed from the basic housing 3, for example, and snapped onto the extra module or snapped on like a bayonet. If necessary, more such modules 51 can be stacked on the basic module of the hearing aid shown in FIG. 1. The extra modules 51 are preferably attached with a snap-on part 43*a* provided on the modules 51, similar to the hinged part 43 on the folding cover 39, as well as a snapping part 46*a* similar to snapping part 46 on said folding cover 39 or, if there is a bayonet lock, by being pushed in, turned and locked.

Thus it is possible to give the hearing aid the simplest modular design desired so that the battery or storage battery 33 is always accessible from the outside.

Electric/Acoustic Transducer Arrangement

Figure 6:
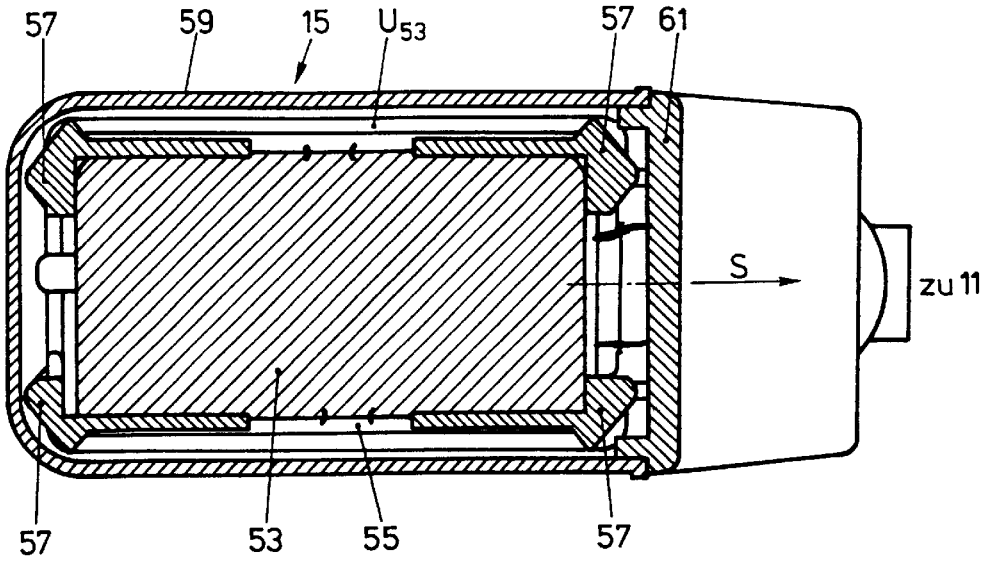
FIG. 6 shows an enlarged view of the electric/acoustic transducer unit on the hearing aid in the invention according to FIG. 1.

FIG. 6 shows a simplified view of the design and mounting of the arrangement 15 mentioned on the basic housing 3 and in the view in FIG. 1. Arrangement 15 includes, encapsulated in a loud-speaker housing 53, the loud-speaker arrangement (not shown) with a loud-speaker membrane. Through coupling holes drawn schematically at 55, the sound waves excited by the loud-speaker membrane from the space on the back of the membrane are coupled in the loud-speaker housing 53 in the surrounding space $U_{53}$ of the loud-speaker housing 53. From the space on the front of the membrane, the acoustic signals—shown by arrow S—are coupled to the transmission channel visible in FIG. 1.

The loud-speaker housing 53 is held on all sides in spring, preferably flexible rubber bearings 57, basically free to oscillate. The relatively large space $U_{53}$ is defined by the bearings 57 between the outer wall of the loud-speaker housing and a capsule 59, which leads to a substantial increase in the low tones. The resonance space on the back of the membrane is increased by a multiple by space $U_{53}$. Capsule 59 and its holder 61 are sealed to make space $U_{53}$ acoustically effective to the full extent.

Thus, acoustically, the storage volume for the loud-speaker arrangement is optimally use. Capsule 59 also acts preferably as a magnetic shield housing and is preferably made of $\mu$ metal for this. It is designed like a cup and hooked on holder 61, which is designed as a plastic support. The spring, preferably flexible rubber bearings 57 mentioned are tensed between the capsule 59, the holder 61 on one side and the loud-speaker housing 53.

Figure 8:
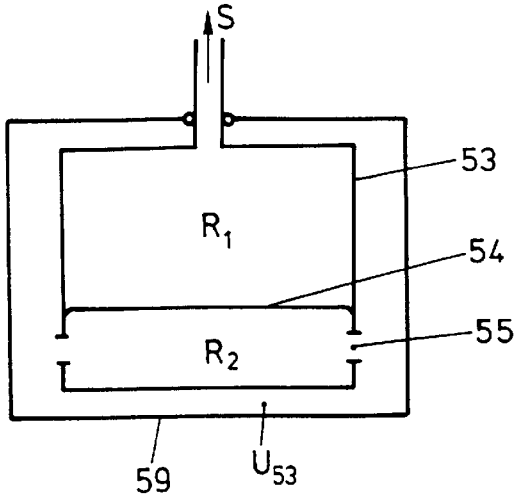
FIG. 8 shows schematically the unit in FIG. 6 to explain the acoustic couplings.

FIG. 8 shows the acoustic coupling explained purely in principle. The membrane 54 of the loud speaker in housing 53 defines in said housing a first space $R_1$, which is coupled to the acoustic output of the hearing aid—shown by S—and a second $R_2$, which is coupled via one or more holes 55 to space $U_{53}$ formed between the capsule 59 and the housing 53.

Activating Switch 31

Figure 7:
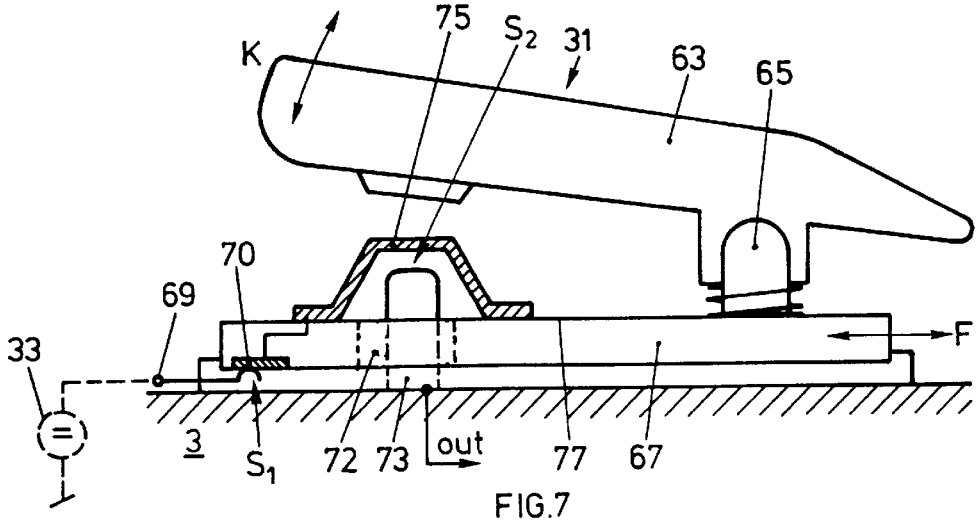
FIG. 7 shows a simplified, schematic view of a preferred activating organ provided on the device in the invention

FIG. 7 shows a preferred form of embodiment of the activating switch 31, simplified and schematically drawn. The activating switch 31 includes a tilt button 63, which is mounted on one side at 65 so it can tilt.

The tilt mount 65 is molded on a slide 67 which—as shown by double arrow F—is mounted so it can move linearly in relation to the basic housing 3. As shown schematically with the spring contact 69 fixed in relation to the basic housing 3 and the bridge contact 70 on the slide 67, the device is turned on and off by the back and forth movement of the slide via button 63.

The slide 67 has a groove 72 going through it through which a contact pill 73 fixed in the housing 3 projects. This is covered by a spring contact part 75 arranged on the slide 67, which is preferably made as a keyboard element of flexible, at least partially electrically conductive plastic, as is known for example from remote-control keyboards. When the tilt button 63—as shown by double arrow K—is pushed, the contact part 75 comes in contact with the pill 73 and makes an electrical connection between these elements. Although for the expert there are a great many possible electrical connections, including a switching strip $S_1$, activated by the slide movement F, and switching strip $S_2$, activated by the tilting movement K of the tilt button 63, preferably—as shown in dashes in FIG. 7—the spring contact 69 is connected to the hearing aid battery 33 and the bridge contact 70 to contact part 75, and thus the contact pill 73 works as an electrical output of the switching arrangement.

Thus, the activating switch 31 works both as an on/off switch and also, in the one position, as a toggle switch, which works—for example for fast individual amplification adjustment—in steps on the electronic unit 27 in FIG. 1.

With the activating switch 31, two functions are combined, a push switch and a toggle switch, a function melding that is highly advantageous especially for the behind-the-ear hearing aid in the invention. The operating difference ensures that there is no confusion in function, which is much more critical when two switches are provided for the two functions mentioned.

Design of Housing 3

As can be seen especially in FIG. 5, the basic housing 3 is made up of a curved, correspondingly molded unmachined part. In one preferred embodiment, this part 3 is designed in one piece, preferably of plastic and is not, as is otherwise usual in the design of such hearing aids, able to be separated into two shells along generating lines represented by M in FIG. 5. Thus occurs the assembly of the individual units in the basic housing 3: they are simply inserted into the ear, which is much simpler than assembly on opened shells. Another advantage of a tubular, one-piece embodiment is its much greater stability compared to a divided housing. This permits a reduction in the housing wall strength and thus a reduction in the size of it, and with a given outer volume, an increase in the usable inner volume.

Advantages of Overall Configuration

Looking at FIG. 1, it can be seen, especially in the preferred one-piece design of the basic housing 3, that the individual components, especially 11, 15, 27, 29 and/or 51, are assembled by axial sequential insertion into the basic housing 3. The shaping of the housing 3 with corresponding guides ensures fast, precise positioning, and reciprocal electrical contact between the electrically operated units is solderless by means of spring contacting. Thus, the units to be provided can be tested out in advance and measured and assembled afterward with no fear of their being affected in any way. This assembly can definitely be automated. The overall housing with basic housing 3 and cover 19, if necessary 39, is provided with corresponding seals at the points of impact that make it simple to seal tight.

The preferred design of the electric/acoustic transducer arrangement 15 ensures optimum magnetic shielding of the loud speaker and optimal acoustic sealing in relation to body sounds.

What is claimed is:

1. A behind-the-ear hearing aid with a hook-shaped, curved shell extending basically along a likewise curved longitudinal axis, at least one acoustic/electric converter within said shell, at least one electric/acoustic converter within said shell, and an electronic unit within said shell, one end of said shell having an acoustic output to the ear, said shell including a compartment for accommodating a cylindrical battery or a rechargeable battery cell, said shell compartment having a substantially cylindrical inner space for accommodating the respectively cylindrical battery or rechargeable battery cell, the cylinder axis of said inner space being substantially coaxial with the longitudinal axis of said shell, said shell compartment being arranged at the opposite end of said shell with respect to said acoustic output, and said shell compartment having an opening substantially coaxial with the longitudinal axis of said shell for introducing and removing the cylindrical battery or rechargeable battery cell, the hearing aid further comprising a module with a plug-in part, said plug-in part residing within said inner space of said shell compartment and said module being releasably fixed to said hearing aid.

2. The hearing aid of claim 1, wherein said module comprising a module compartment with a further inner space, said further inner space being substantially equally configured as said inner space of said shell compartment.

3. The hearing aid of claim 1, wherein said module comprises a module compartment with a further inner space and a cover having a closed position for closing in said inner space of said module compartment.

4. The hearing aid of claim 3, wherein said cover is lockable.

5. The hearing aid of claim 4, wherein said cover is lockable and unlockable by means of a tool.

6. The hearing aid of claim 3, wherein said cover is removable from and re-installable to said module.

7. The hearing aid of claim 3, wherein there is provided a code at said cover, said code being indicative of the fact whether said hearing aid with said module is conceived for right ear or left ear appliance.

8. The hearing aid of claim 7, wherein said code is applied to an area of a lock at said cover, said code being detectable from outside said hearing aid.

9. The hearing aid of claim 3, wherein said cover of said module may be applied to said shell compartment of said hearing aid, once said module is removed from said hearing aid.

10. The hearing aid of claim 1, wherein said module is one of a chargeable battery module, battery module, manually operable control unit module, programming unit module, wireless communication module, acoustical to electrical converter module.

11. A behind-the-ear hearing aid with a hook-shaped, curved shell extending basically along a likewise curved longitudinal axis, at least one acoustic/electric converter within said shell, at least one electric/acoustic converter within said shell, and an electronic unit within said shell, one end of said shell having an acoustic output to the ear, said shell including a compartment for accommodating a cylindrical battery or a rechargeable battery cell, said shell compartment having a substantially cylindrical inner space for accommodating the respectively cylindrical battery or rechargeable battery cell, the cylinder axis of said inner space being substantially coaxial with the longitudinal axis of said shell, said shell compartment being arranged at the opposite end of said shell with respect to said acoustic output, said shell compartment having an opening substantially coaxial with the longitudinal axis of said shell for introducing and removing the cylindrical battery or rechargeable battery cell, and said shell compartment having a cover having a closed position for closing in said inner space and being disposed in said closed position substantially along a plane perpendicular to said axis.

12. The hearing aid of claim 11, wherein said cover being lockable in said closed position.

13. The hearing aid of claim 12, wherein said cover is lockable and unlockable by means of a tool.

14. The hearing aid of claim 11, wherein said cover is removable and re-installable from and to said hearing aid.

15. The hearing aid of claim 11, wherein said cover comprises a code which is indicative of whether said hearing aid is intended for left ear or for right ear appliance.

16. The hearing aid of claim 15, wherein said code is provided at a part of a lock for said cover, said code being detectable from outside said hearing aid.

* * * * *